US009620055B2

(12) United States Patent
Park et al.

(10) Patent No.: US 9,620,055 B2
(45) Date of Patent: Apr. 11, 2017

(54) ORGANIC ELECTROLUMINESCENT DISPLAY DEVICE INCLUDING GAMMA REFERENCE VOLTAGE GENERATOR AND METHOD OF DRIVING THE SAME

(75) Inventors: Byung-Hwee Park, Daegu (KR); Seung-Kyu Kim, Seongnam-si (KR)

(73) Assignee: LG DISPLAY CO., LTD., Seoul (KR)

( * ) Notice: Subject to any disclaimer, the term of this patent is extended or adjusted under 35 U.S.C. 154(b) by 1047 days.

(21) Appl. No.: 12/314,389

(22) Filed: Dec. 9, 2008

(65) Prior Publication Data

US 2009/0160880 A1 Jun. 25, 2009

(30) Foreign Application Priority Data

Dec. 21, 2007 (KR) ..... 10-2007-0135133

(51) Int. Cl.
*G09G 3/30* (2006.01)
*G09G 3/3233* (2016.01)

(52) U.S. Cl.
CPC ... *G09G 3/3233* (2013.01); *G09G 2300/0842* (2013.01); *G09G 2320/0271* (2013.01); *G09G 2320/0673* (2013.01); *G09G 2330/021* (2013.01); *G09G 2360/16* (2013.01)

(58) Field of Classification Search
USPC ..... 345/77, 690
See application file for complete search history.

(56) References Cited

U.S. PATENT DOCUMENTS

| | | | | |
|---|---|---|---|---|
| 7,312,776 | B2 * | 12/2007 | Bu | 345/88 |
| 7,352,352 | B2 * | 4/2008 | Oh et al. | 345/102 |
| 7,358,988 | B1 * | 4/2008 | Konishi et al. | 348/222.1 |
| 7,375,711 | B2 * | 5/2008 | Horiuchi et al. | 345/89 |
| 7,609,244 | B2 * | 10/2009 | Kim et al. | 345/89 |
| 7,714,928 | B2 * | 5/2010 | Kamon et al. | 348/362 |
| 7,782,281 | B2 * | 8/2010 | Oh et al. | 345/87 |
| 2006/0087521 | A1 * | 4/2006 | Chu et al. | 345/690 |
| 2006/0114205 | A1 * | 6/2006 | Shen et al. | 345/88 |
| 2006/0214895 | A1 * | 9/2006 | Shih et al. | 345/88 |
| 2006/0244696 | A1 * | 11/2006 | Jung et al. | 345/77 |
| 2007/0057959 | A1 * | 3/2007 | Cho et al. | 345/589 |
| 2008/0278430 | A1 * | 11/2008 | Kim et al. | 345/99 |

FOREIGN PATENT DOCUMENTS

| | | |
|---|---|---|
| CN | 1389844 | 1/2003 |
| CN | 1637826 | 7/2005 |
| KR | 1020050068172 A | 7/2005 |
| KR | 1020060114573 A | 11/2006 |

* cited by examiner

*Primary Examiner* — Kwang-Su Yang
(74) *Attorney, Agent, or Firm* — Dentons US LLP

(57) ABSTRACT

An organic electroluminescent display device, includes: a gray level extractor that extracts gray levels of frame data signals for a frame image; an image type determiner that determines a type of the frame image using a distribution of the gray levels of the frame data signals, the type of the frame image being one of a low-gray-level type, a medium-gray-level type and a high-gray-level type; a gamma reference voltage generator that selects a set of gamma reference voltages based upon the image type; a data driver converting the frame data signals into frame data voltages using the selected set of gamma reference voltages; a timing controller that supplies the frame data signals to the data driver; and a display area including pixels having an organic light emitting diode that display the frame image.

14 Claims, 5 Drawing Sheets

ORGANIC ELECTROLUMINESCENT DISPLAY DEVICE INCLUDING GAMMA REFERENCE VOLTAGE GENERATOR AND METHOD OF DRIVING THE SAME

The present invention claims the benefit of Korean Patent Application No. 2007-0135133, filed in Korea on Dec. 21, 2007, which is hereby incorporated by reference for all purposes as if fully set forth herein.

BACKGROUND OF THE INVENTION

Field of the Invention

The present invention relates to an organic electroluminescent display device, and more particularly, an organic electroluminescent display device and a method of driving the same.

Discussion of the Related Art

Commercially available display devices include cathode-ray tubes (CRT) and various types of flat panel displays. However, the various types of flat panel displays, such as liquid crystal display (LCD) devices, plasma display panel (PDP) devices, field emission display (FED) devices, and electroluminescent display (ELD) devices, are currently being developed as substitutes for the CRT. For example, advantages of LCD devices include a thin profile and low power consumption. However, LCD devices require a backlight unit because they are non-luminescent display devices. Organic electroluminescent display (OELD) devices, however, are self-luminescent display devices. OELD devices operate at low voltages and have a thin profile. Further, the OELD devices have fast response time, high brightness, and wide viewing angles.

FIG. 1 is a circuit diagram illustrating an OELD device according to the related art, and FIG. 2 is a timing chart of signals for operating the OELD of FIG. 1.

Referring to FIG. 1, the OELD device includes gate and data lines S and D crossing each other to define a sub-pixel region. The sub-pixel region includes a switching transistor SW, a capacitor C, a driving transistor DR and an organic emitting diode OLED.

Gate and source electrodes of the switching transistor SW are connected to the gate and data lines S and D, respectively. One electrode of the capacitor C is connected to a drain electrode of the switching transistor SW, and the other electrode of the capacitor C is connected to a reference voltage (VSS) source. Drain, gate and source electrodes of the driving transistor DR are connected to a cathode of the organic emitting diode OLED, the drain electrode of the switching transistor SW, and the reference voltage (VSS) source. An anode of the organic emitting diode OELD is connected to a power voltage (VDD) source.

Referring to FIG. 2, an $n^{th}$ gate voltage having a level of VGH is applied to a $n^{th}$ gate line S(n), a switching transistor SW connected to the $n^{th}$ gate line S(n) is turned on, and a data voltage Vdata is applied to the data line D and stored in the capacitor C. A current flowing in the driving transistor DR is determined according to a difference between the stored voltage in the capacitor C and the power voltage VDD. The OLED emits light according to the current passing through the OLED.

SUMMARY OF THE INVENTION

Accordingly, the present invention is directed to an organic electroluminescent display device that substantially obviates one or more of the problems due to limitations and disadvantages of the related art.

An advantage of the present invention is to provide an organic electroluminescent display device and a method of driving the same that can improve distinction in displaying a dark image and reduce power consumption in displaying a bright image.

Additional features and advantages of the present invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described herein, an organic electroluminescent display device, includes: a gray level extractor that extracts gray levels of frame data signals for a frame image; an image type determiner that determines a type of the frame image using a distribution of the gray levels of the frame data signals, the type of the frame image being one of a low-gray-level type, a medium-gray-level type and a high-gray-level type; a gamma reference voltage generator that selects a set of gamma reference voltages based upon the image type; a data driver converting the frame data signals into frame data voltages using the selected set of gamma reference voltages; a timing controller that supplies the frame data signals to the data driver; and a display area including pixels having an organic light emitting diode that display the frame image.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to illustrated embodiments of the present invention, which are illustrated in the accompanying drawings.

Figure 3:
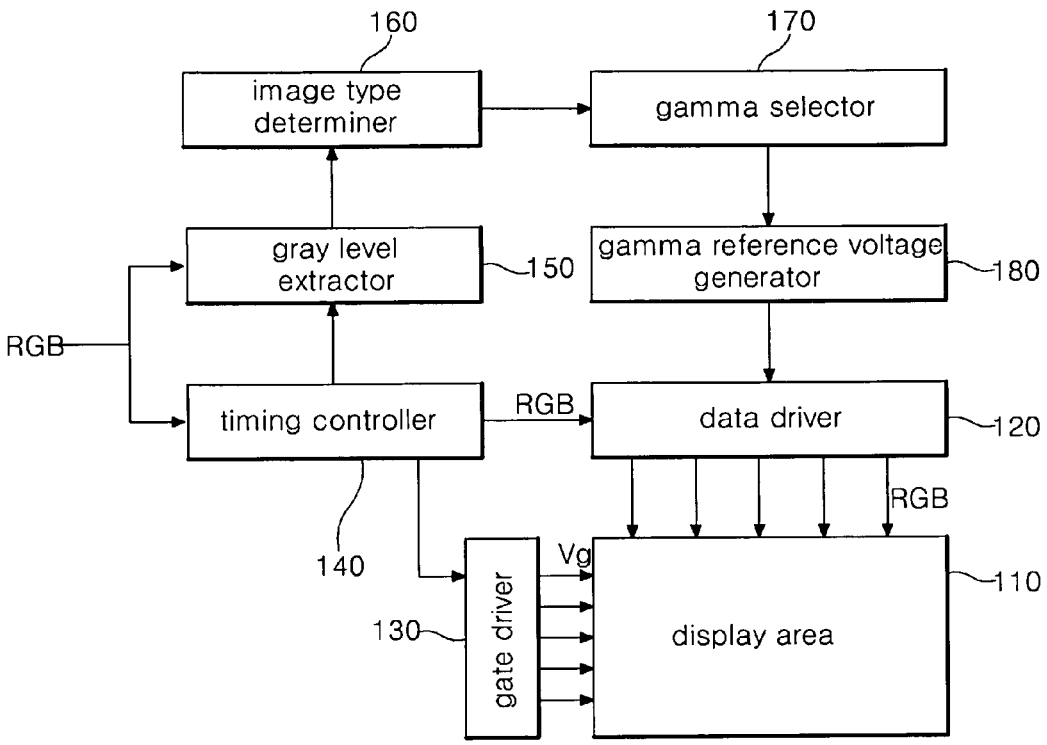
FIG. 3 is a block diagram illustrating an OLED device according to an embodiment of the present invention.

FIG. 3 is a block diagram illustrating an OLED device according to an embodiment of the present invention.

Referring to FIG. 3, the OLED device 100 includes a display area 110 and a driving portion. The driving portion includes a data driver 120, a gate driver 130, a timing controller 140, a gray level extractor 150, an image type determiner 160, a gamma selector 170, and a gamma voltage generator 180.

Figure 1:
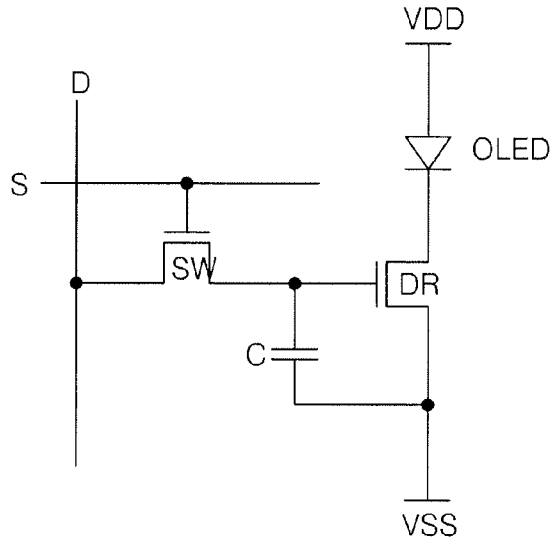
FIG. 1 PRIOR ART
FIG. 1 is a circuit diagram illustrating an OELD device according to the related art.
Figure 2:
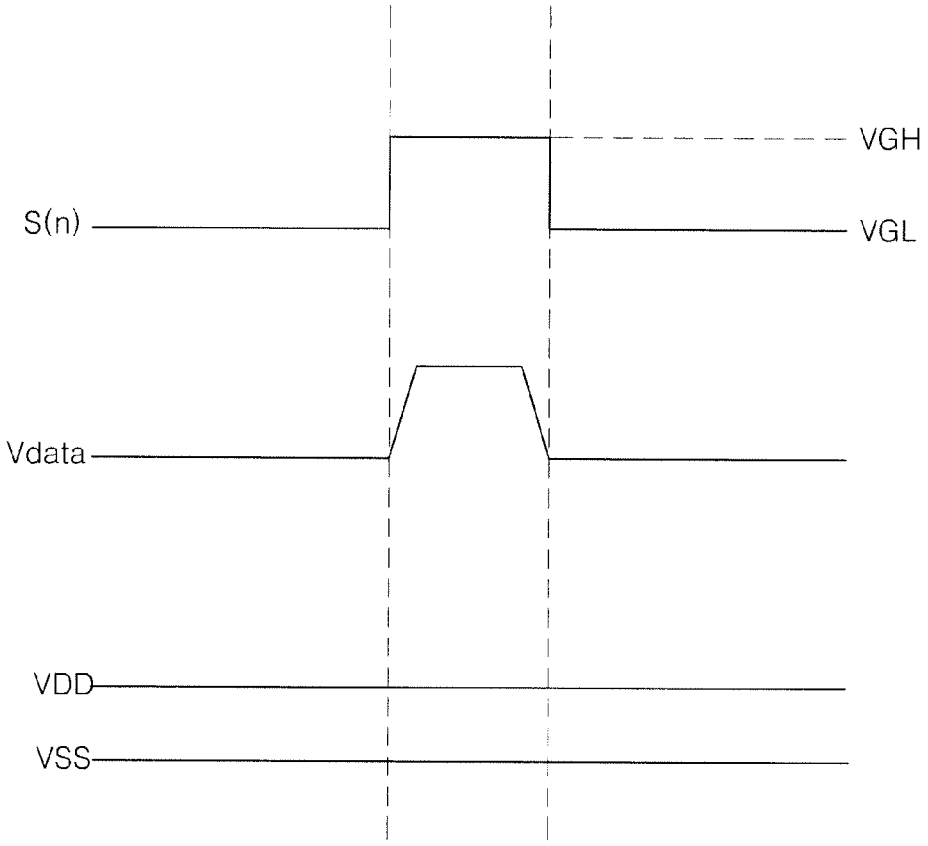
FIG. 2 PRIOR ART
FIG. 2 is a timing chart of signals for operating the OELD of FIG. 1.

The display area 110 includes a plurality of sub-pixel regions in a matrix form to display images. The display area 110 may have a structure similar to the structure of FIG. 1. For example, the display area 110 includes gate and data lines S and D crossing each other to define the sub-pixel region, and in the sub-pixel region, the switching transistor SW, the capacitor C, the driving transistor DR, and the organic emitting diode OLED are formed. The switching and driving transistors S and D may be a negative type transistor and include a semiconductor layer made of amorphous silicon.

The gate line S is connected to the gate driver 130 to be supplied with a gate voltage. The switching transistor SW connected to the gate line S is turned on or off according to an on or off level of the gate voltage. The data line is connected to the data driver 120 that supplies a data voltage.

The gamma reference voltage generator 180 supplies gamma reference voltages to the data driver 120. The gamma reference voltages are used to generate the data voltage. In the present embodiment, a plurality of sets of gamma reference voltages are generated, and one of the plurality of sets of gamma reference voltages is output to the data driver 120 according to an image type.

The timing controller 140 receives process data signals, and outputs the data signals to the data driver 120. The data signals may be digital. The data signal may include R, G and B data signals corresponding to R, G and B sub-pixels, respectively, and the data signal corresponds to a pixel, which includes the R, G and B sub-pixels, as a unit element to display images.

Further, the timing controller 140 outputs control signals to the data driver 120 and the gate driver 130.

The gray level extractor 150 extracts gray levels from the data signals. For example, the gray level extractor 150 extracts the gray level of each data signal. The gray level extractor 150 may convert the RGB type data signals into YUV (YCrCb) type data signals. The YUV type data signal is referred to as a color difference signal including a luminance component Y.

The YUV type data signal may be generated by the following formulas (1) to (3):

$$Y=0.299R+0.587G+0.114B \quad \text{Formula (1)}$$

$$U=-0.147R-0.289G+0.436B \quad \text{Formula (2)}$$

$$V=0.615R-0.515G-0.100B \quad \text{Formula (3)}$$

A gray level corresponding to a value of the luminance component Y is the gray level of the data signal.

In the present embodiment, it is assumed that the data signals are data signals for one frame that may be referred to as frame data signals. According to this assumption, when the display area 110 has A*B pixels, the gray level extractor 150 obtains A*B gray levels of the A*B frame data signals that may be referred to as frame gray levels.

The image type determiner 160 determines the type of the image displayed for the frame according to the frame data signals, which may be referred to as a frame image, based upon the frame gray levels. The frame image may be categorized into a low-gray-level type image, a middle-gray-level type image or a high-gray-level type image. The low-gray-level type image may be a dark image and have low gray level data signals dominating the frame image. The high-gray-level type image may be a bright image and have high gray level data signals dominating the frame image. The middle-gray-level image may be an image having a brightness between the brightnesses of the low and the high-gray-level type images and have middle gray level data signals dominating the frame image.

Figure 4A:
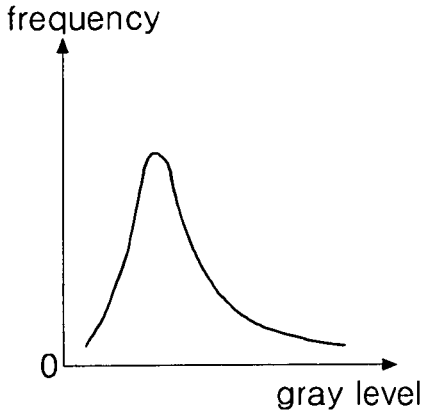
FIGS. 4A to 4C are histograms illustrating distributions of frame gray levels of low, middle and high-gray-level type images, respectively.
Figure 4B:
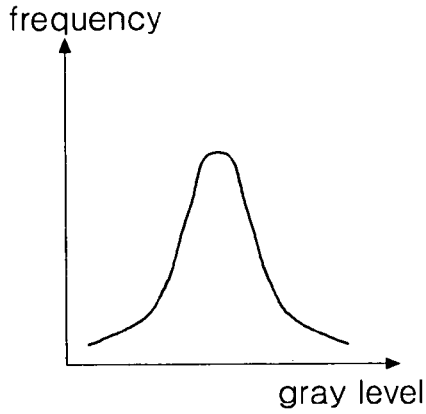
Figure 4C:
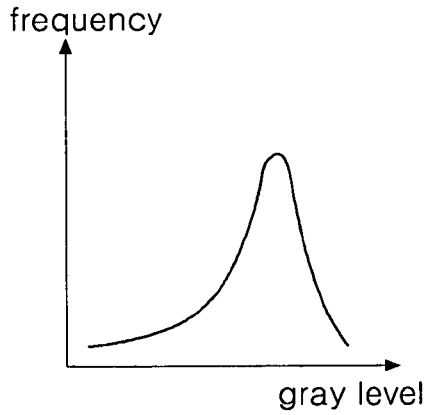

The method of determining the image type may be explained with respect to FIGS. 3 and 4A to 4C. FIGS. 4A to 4C are histograms illustrating distributions with frame gray levels for low, middle and high-gray-level type images, respectively.

A chart, such as a histogram, showing a distribution of the frame gray levels generated by the gray level extractor 150 is made.

The frame image type is determined by the image type determiner 160 based upon the distribution of the frame gray levels. When the frame image has the histogram like in FIG. 4A, the frame image is determined to be the low-gray-level type image. When the frame image has the histogram like in FIG. 4B, the frame image is determined to be the middle-gray-level type image. When the frame image has the histogram like in FIG. 4C, the frame image is determined to be the high-gray-level type image. When the data signal is a 8-bit RGB signal, the histogram of FIG. 4A may have $0^{th}$ to $85^{th}$ gray level data signals dominant, the histogram of FIG. 4B may have $86^{th}$ to $172^{nd}$ gray level data signals dominant, and the histogram of FIG. 4C may have $173^{rd}$ to $255^{th}$ gray level data signals dominant.

Figure 5:
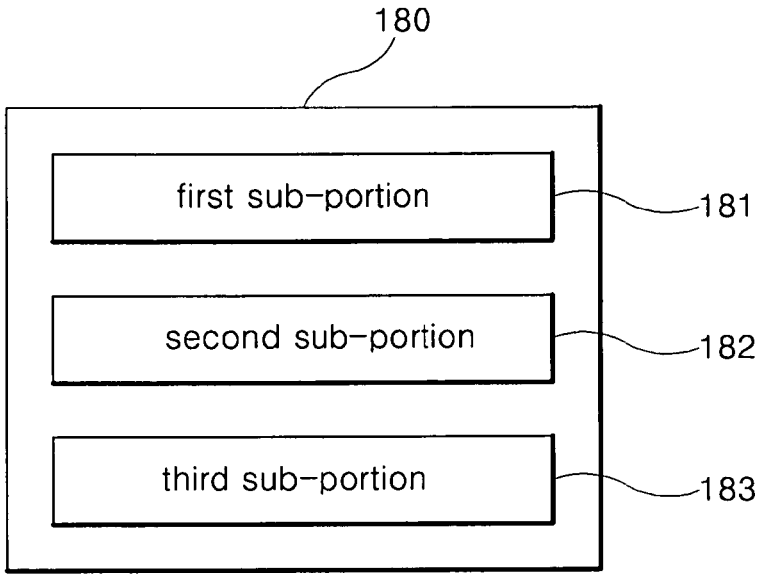
FIG. 5 is a diagram illustrating the gamma reference voltage generator including first to third sub-sections of FIG. 4.
Figure 6:
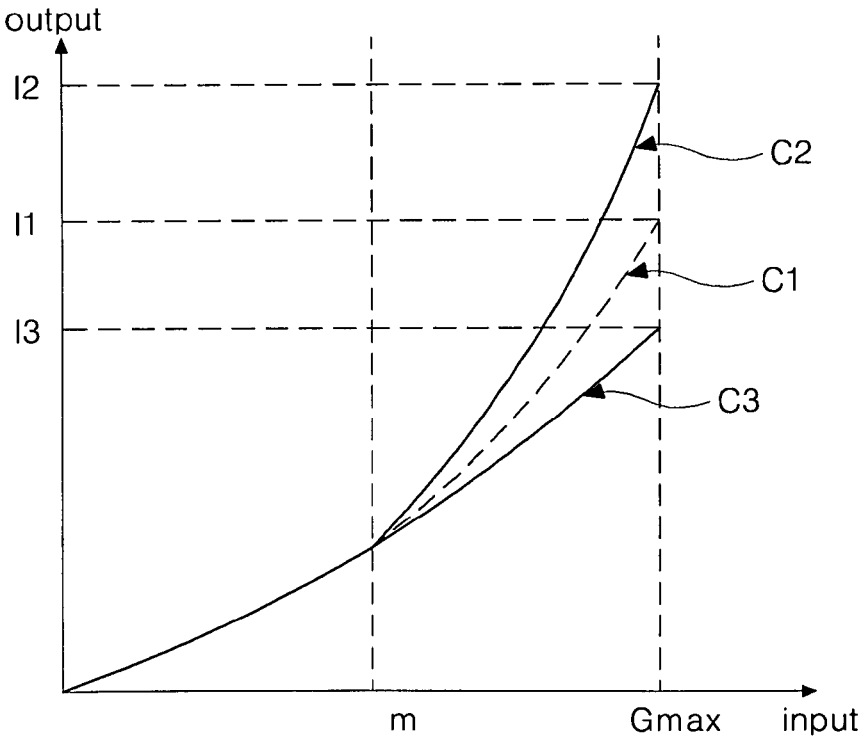
FIG. 6 is a graph illustrating first to third gamma curves for gamma reference voltages of the first to third sub-sections of FIG. 5, respectively.

FIG. 5 is a view illustrating the gamma reference voltage generator 180 including first to third sub-sections of FIG. 4, and FIG. 6 is a graph illustrating first to third gamma curves for gamma reference voltages of the first to third sub-sections of FIG. 5, respectively.

Referring to FIGS. 5 and 6, the gamma reference voltage generator 180 includes a plurality of sub-sections, for example, first to third sub-sections 181 to 183. The first to third sub-sections 181 to 183 generate first to third sets of gamma reference voltages, respectively, and the first to third sets of gamma voltages are different from one another. Accordingly, the first to third gamma curves C1 to C3 for the first to third sets of gamma voltages, respectively, are different.

The first to third gamma curves C1 to C3 vary differently from one another. In the graph, an input may be a gray level, and an output may be a desired luminance. The first to third gamma curves C1 to C3 have maximum outputs I1, I2 and I3, respectively, at a maximum input Gmax.

The first gamma curve C1 may be fitted to a sRGB standard gamma 2.2 curve. The maximum output I2 of the second gamma curve C2 may be about 200% of the maximum output I1 of the first gamma curve C1. The maximum output I3 of the third gamma curve C3 may be about 60% of the maximum output I1 of the first gamma curve C1. Alternatively, the first to third gamma curves may be changed, for example, by a designer such as a manufacturer.

The first to third gamma curves C1 to C3 may have the same curve up to an input level m, and have the different curve above the input level m.

Each of the first to third sub-sections 181 to 183 includes in-series resistors dividing a voltage VDD. Accordingly, each of the first to third sub-sections 181 to 183 outputs each set of gamma reference voltages at nodes between the resistors. In order for the first to third sub-sections 181 to 183 to form the different first to third gamma curves I1 to I3, some of the resistors between the first to third sub-sections 181 to 183 may have a different resistance.

When the image type is determined, one of the first to third sub-sections 181 to 183 is selected, and the selected sub-section outputs the corresponding set of gamma reference voltages. For example, when the frame image is determined to be the middle-gray-level type image, the first sub-section 181 is selected, and the first sub-section 181 outputs the first set of gamma reference voltages for the first gamma curve C1. When the frame image is determined to be the low-gray-level type image, the second sub-section 182 is selected, and the second sub-section 182 outputs the second set of gamma reference voltages for the second gamma curve C2. The low-gray-level type image is dark overall. Accordingly, the second sub-section 182 for the second gamma curve C2 is selected, thus a bright portion of the dark image may be highlighted and distinction over the dark image can increase. When the frame image is determined to be the high-gray-level type image, the third sub-section 183 is selected, and the third sub-section 183 outputs the third set of gamma reference voltages for the third gamma curve C3. The high-gray-level type image is bright overall. Accordingly, the third sub-section 183 for the third gamma curve C3 is selected, thus a luminance of a bright portion of the bright image may be reduced so as to not hamper visibility and so that power consumption can be reduced.

Figure 7:
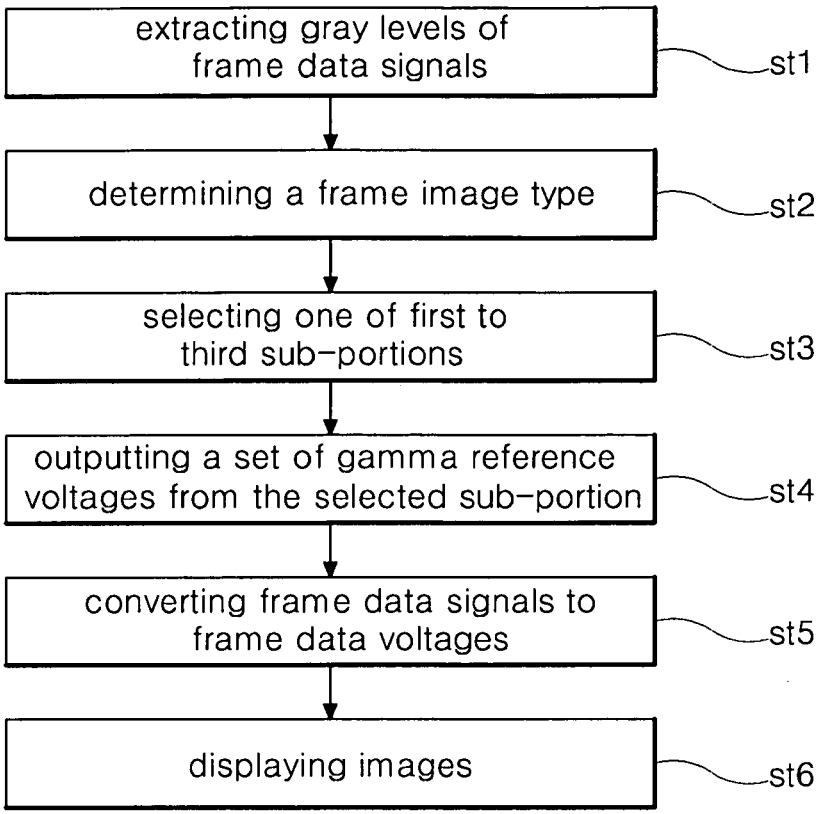
FIG. 7 is a flow chart illustrating operations of the OLED device according to the present invention.

FIG. 7 is a flow chart illustrating the operation of the OLED device according to the present invention.

Referring to FIGS. 5 and 7, in a first step st1, the gray level extractor 150 extracts the gray levels of the frame data signals supplied from an external system such as a graphic card and a TV system. The frame gray levels may be obtained using the aforementioned formula (1) and a luminance-to-gray level table. The luminance-to-gray level table may be installed in the gray level extractor 150.

In a second step st2, the image type determiner 160 determines the frame image type according to the distribution of the frame gray levels. The image type may be categorized into the low-gray-level type, middle-gray-level type, and high-gray-level type. In determining the image type, for example, a method of FIG. 8 may be used. It should be noted that any number of image types may be identified and used in the present invention as well as various methods to correlate a given image with one of the image types.

Figure 8:
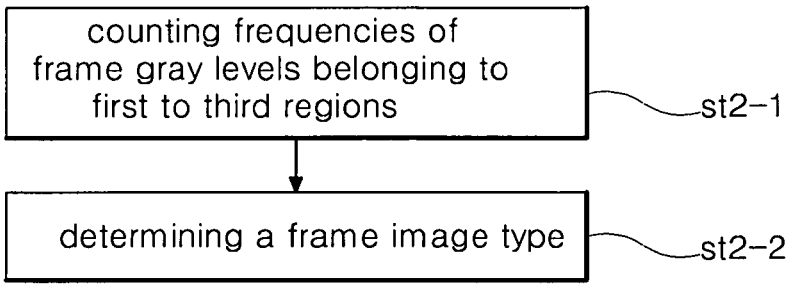
FIG. 8 is a flow chart illustrating a method of determining an image type in the OLED device according to the present invention.

FIG. 8 is a flow chart illustrating a method of determining an image type in the OLED device according to the present invention.

Referring to FIG. 8, in a first step st2-1, the number of the frame gray levels belonging to a plurality of regions may be determined by counting. For example, the plurality of regions may be first to third regions for which a gray level range permissible for the frame data signal is divided into. The first region may be a low gray level region, the second region may be a middle gray level region, and the third region may be a high gray level region. When the data signal is a 8-bit RGB data signal, the gray level range is $0^{th}$ to $255^{th}$ gray levels, a range of the first region may be $0^{th}$ to $85^{th}$ gray levels, a range of the second region may be $86^{th}$ to $172^{nd}$ gray levels, and a range of the third region may be $173^{rd}$ to $255^{th}$ gray levels. Accordingly, in the first step ST2-1, the number of the frame gray levels belonging to the first region, the number of the frame gray levels belonging to the second region, and the number of the frame gray levels belonging to the third region may be counted.

In a second step st2-2, the image type may be determined according to the number of gray levels found in each of the first to third regions. For example, the frame image is the low-gray-level type image when the number of gray levels of the first region is the greatest, the frame image is the middle-gray-level type image when the number of gray levels of the second region is the greatest, and the frame image is the high-gray-level type image when the number of gray levels of the third region is the greatest.

After the image type is determined in the second step st2-2 the process of FIG. 8 is complete and the process returns to the thirds step st3 as shown in FIG. 7. In a third step st3, the gamma selector 170 selects one of the first to third sub-sections 181 to 183 corresponding to the determined image type.

In a fourth step st4, the selected one of the first to third sub-sections 181 to 183 outputs the corresponding set of gamma reference voltages to the data driver 120.

In a fifth step st5, the data driver 120 converts the frame data signals to the data voltages for the frame which may be referred to as frame data voltages. The data voltage corresponding to a pixel may include R, G, and B data voltages corresponding to R, G and B sub-pixels of the pixel, respectively.

In a sixth step st6, the frame data voltages are applied to the all pixels of the display area 110 to display images.

In the embodiment as described above, the second gamma curve is selected for the dark image overall, thus a bright portion of the dark image may be highlighted and distinction over the dark image can increase. The third gamma curve is selected for the bright image overall, thus a luminance of a bright portion of the bright image can be reduced so as to not hamper visibility and so that power consumption may be reduced.

When the first gamma curve is sRGB standard gamma 2.2 curve, an experiment shows that the maximum output of the second gamma curve being of about 200% of the maximum output of the first gamma curve, and the maximum output of the third gamma curve being of about 60% of the maximum output of the first gamma curve.

The present invention may be applied to other flat display devices, for example, a liquid crystal display devices, a plasma display panels, and the like.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An organic electroluminescent display device, comprising:

a gray level extractor that extracts gray levels of frame data signals for a frame image;

an image type determiner that determines a type of the frame image using a distribution of the gray levels of the frame data signals, the type of the frame image being one of a low-gray-level type, a medium-gray-level type and a high-gray-level type;

a gamma reference voltage generator that selects one of first to third sets of gamma reference voltages based upon the type of the frame image, the first to third sets of the gamma reference voltages corresponding to the low-gray-level type, the medium-gray-level type and the high-gray-level type, respectively;

a data driver converting the frame data signals into frame data voltages using the selected set of the gamma reference voltages;

a timing controller that supplies the frame data signals to the data driver; and a display area including pixels having an organic light emitting diode that display the frame image, wherein a maximum luminance of a first gamma curve of the first set of the gamma reference voltages is greater than a maximum luminance of a third gamma curve of the third set of the gamma reference voltages, wherein each of the first gamma curve to the third gamma curve includes red, green and blue colors, wherein the maximum luminance of the first gamma curve of the first set of the gamma reference voltages is greater than a maximum luminance of a second gamma curve of the second set of the gamma reference voltages, and the maximum luminance of the second gamma curve of the second set of the gamma reference voltages is greater than the maximum luminance of the third gamma curve of the third set of the gamma reference voltages, wherein the first to third gamma curves have substantially the same curve up to a predetermined gray level between a minimum gray level and a maximum gray level of a gray level range permissible for the frame data signal, and wherein the first to third gamma curves have a different curve over the predetermined gray level.

2. The device according to claim 1, wherein the frame data signal supplied to the gray level extractor is a RGB type data signal, the gray level extractor converts the frame data signal to a YUV type data signal, and the gray level of the frame data signal is extracted using a Y value of the YUV type data signal.

3. The device according to claim 1, wherein the image type determiner counts frequencies of the gray levels of the frame data signals belonging to low, middle and high gray level regions into which a gray level range permissible for the frame data signal is divided and determines the type of the frame image as one of the low, middle and high-gray-level type according to the frequency count of the low, medium and high gray level regions.

4. The device according to claim 1, wherein the gamma reference voltage generator includes first to third sub-sections that generate the first to third sets of the gamma reference voltages, respectively, and each includes in-series resistors.

5. The device according to claim 1, wherein the pixel further includes a switching transistor connected to gate and data lines crossing each other, a driving transistor connected to the switching transistor and the organic light emitting diode, and a capacitor connected to gate and source electrodes of the driving transistor.

6. A method of driving an organic electroluminescent display device, comprising:

extracting gray levels of frame data signals for a frame image;

determining a type of the frame image using a distribution of the gray levels of the frame data signals, the type of the frame image being one of a low-gray-level type, a medium-gray-level type and a high-gray-level type;

selecting one of first to third sets of gamma reference voltages corresponding to the selected type, the first to third sets of the gamma reference voltages corresponding to the low-gray-level type, the medium-gray-level type and the high-gray-level type, respectively;

converting the frame data signals into frame data voltages using the selected set of the gamma reference voltages; and applying the frame data voltages to pixels of the display area having an organic light emitting diode to display the frame image, wherein a maximum luminance of a first gamma curve of the first set of the gamma reference voltages is greater than a maximum luminance of a third gamma curve of the third set of the gamma reference voltages, wherein each of the first gamma curve to the third gamma curve includes red, green and blue colors, wherein the maximum luminance of the first gamma curve of the first set of the gamma reference voltages is greater than a maximum luminance of a second gamma curve of the second set of the gamma reference voltages, and the maximum luminance of the second gamma curve of the second set of the gamma reference voltages is greater than the maximum luminance of the third gamma curve of the third set of the gamma reference voltages, wherein the first to third gamma curves have substantially the same curve up to a predetermined gray level between a minimum gray level and a maximum gray level of a gray level range permissible for the frame data signal, and wherein the first to third gamma curves have a different curve over the predetermined gray level.

7. The method according to claim 6, wherein the frame data signal is a RGB type data signal, extracting the gray levels of the frame data signals includes converting the frame data signal to a YUV type data signal, and the gray level of the frame data signal is extracted using a Y value of the YUV type data signal.

8. The method according to claim 6, wherein determining the type of the frame image includes counting frequencies of the gray levels of the frame data signals belonging to low, middle and high gray level regions into which a gray level range permissible for the frame data signal is divided, and determining the type of the frame image as one of the low, middle and high-gray-level type according to the frequency count of the low, medium and high gray level regions.

9. The method according to claim 6, wherein the pixel further includes a switching transistor connected to gate and data lines crossing each other, a driving transistor connected to the switching transistor and the organic light emitting diode, and a capacitor connected to gate and source electrodes of the driving transistor.

10. A method of driving an organic electroluminescent display having a plurality of display pixels comprising:

extracting gray level information for each display pixel in a frame of image data;

determining an image type of the frame of the image data from the extracted gray level information, the image type including a dark image type and a bright image type;

selecting one of sets of gamma reference voltages corresponding to the determined image type, the sets of the gamma reference voltages including a set of the gamma reference voltages corresponding to the dark image type and another set of the gamma reference voltages corresponding to the bright image type;

converting frame image data for each display pixel to data voltages according the selected gamma reference voltages; and driving each display pixel with the corresponding data voltage to display an image, wherein a maximum luminance of a gamma curve of the set of the gamma reference voltages corresponding to the dark image type is greater than a maximum luminance of another gamma curve of the another set of the gamma reference voltages corresponding to the bright image type, wherein each of the gamma curves includes red, green and blue colors, wherein the gamma curves have substantially the same curve up to a predetermined gray level between a minimum gray level and a maximum gray level of a gray level range permissible for the frame data signal, and wherein the gamma curves have a different curve over the predetermined gray level.

11. The method of claim 10, wherein the image type includes n different types of image types, each image type corresponding to different levels of image brightness, where n is an integer greater than one.

12. The method of claim 11, wherein selecting the one of the sets of the gamma reference voltages includes selection of one of n different sets of the gamma reference voltages corresponding to the n image types.

13. The method of claim 11, wherein determining the image type includes determining n different ranges of brightness and then counting how many pixels have a gray level within each of the n different ranges of brightness, and selecting the image type based upon the range that has the greatest number of gray levels.

14. The method according to claim 10, wherein the frame data signal is a RGB type data signal, extracting the gray levels of the frame data signals includes converting the frame data signal to a YUV type data signal, and the gray level of the frame data signal is extracted using a Y value of the YUV type data signal.

* * * * *